United States Patent [19]

Bodart

[11] 4,164,965

[45] Aug. 21, 1979

[54] COMBINATION LOG SAW AND SPLITTER MACHINE

[75] Inventor: Ronald A. Bodart, Oconto Falls, Wis.

[73] Assignee: Little Gem Manufacturing, Inc., Oconto Falls, Wis.

[21] Appl. No.: 911,352

[22] Filed: Jun. 1, 1978

[51] Int. Cl.[2] ..... B27L 7/00

[52] U.S. Cl. ..... 144/3 K; 83/928; 144/193 A

[58] Field of Search ..... 144/3 K, 193 R, 193 A, 144/323, 326.12, 312; 83/928

[56] References Cited

U.S. PATENT DOCUMENTS

| | | | |
|---|---|---|---|
| 3,862,651 | 1/1975 | Heikkinen | 144/193 A X |
| 4,076,062 | 2/1978 | Kanik | 144/193 A |
| 4,128,117 | 12/1978 | Terry | 144/3 K |

*Primary Examiner*—Robert Louis Spruill
*Assistant Examiner*—W. D. Bray
*Attorney, Agent, or Firm*—James E. Nilles

[57] ABSTRACT

A machine for cutting logs into lengths and then splitting the logs, the entire machine being portable. A common power source is provided for the circular saw and the log splitter, and the sawing and splitting operations can be performed independently of one another and either selectively or simultaneously. The machine includes a frame having the circular saw located adjacent one side of its top side and a slideable table feeds the logs into the saw. The log splitter is located on a large, rigid backbone of the machine frame and which also forms a tongue portion of the machine. The circular saw and the splitter are both hydraulically powered and controlled.

7 Claims, 9 Drawing Figures

COMBINATION LOG SAW AND SPLITTER MACHINE

BACKGROUND OF THE INVENTION

1. Field of Use

The invention pertains to machines for cutting logs into lengths and splitting them, the entire machine being rendered mobile.

2. Description of the Prior Art

Prior art devices of this general character are shown in U.S. Pat. No. 1,001,272 issued Aug. 22, 1911 to Howard, U.S. Pat. No. 1,441,996 issued Jan. 9, 1923 to Mukai, and U.S. Pat. No. 1,598,695 issued Sept. 7, 1926 to Anderson, all of which show combined machines for providing both wood cutting and wood splitting. These machines are all complicated, heavy, and cumbersome both to transport and operate and do not provide flexibility or ease of operation of the sawing and splitting functions.

SUMMARY OF THE INVENTION

The present invention provides a combined log saw and splitting machine which is mobile and can be easily transported to the job site. It can be easily converted from an operating to a transporting position. The invention also contemplates a sliding table for feeding the logs into the saw blade and in which a guard is provided for the saw blade and is in proper position at all times to protect the operator. A more specific aspect of the invention relates to biasing the table to a retracted or loading position. The invention furthermore contemplates a heavy backbone member of the frame on which the log splitting components are mounted and which backbone also provides the tongue portion for the machine by which it can be hitched to a towing vehicle. A single power source is provided for hydraulically operating and controlling both the circular saw and the log splitter, and each function can be individually and separately performed.

Other objects and advantages of the present invention will appear hereinafter as this disclosure progresses, reference being had to the accompanying drawings.

Description of the Preferred Embodiment

Figure 1:
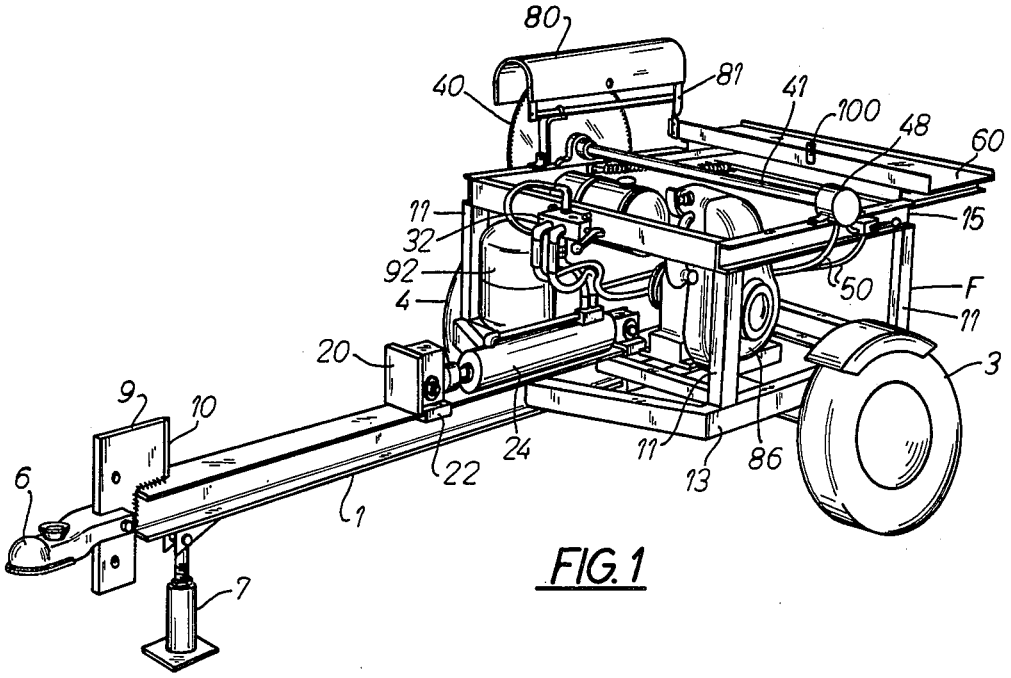
FIG. 1 is a perspective view of the machine concerning the present invention.

The machine frame F is fabricated by welding and from steel structural members and includes a longitudinally extending I-beam 1 which extends throughout the length of the frame of the machine and forms a single, rigid backbone thereof. The transverse axle 2 formed of a tubular steel member is welded to the underside of the I-beam 1 and ground transport wheels 3 and 4 are journalled in the conventional manner at opposite ends of the axle 2, thereby rendering the entire machine easily transportable. At the front end of the frame backbone there is a conventional hitch 6 and a jack stand 7 for levelling the machine. A pair of rear jack stands 8 (one shown) are also provided at the rear of the frame. Also, at the front end of the backbone or beam 1 is a vertically extending knife member 9 having a sharp edge 10.

The frame also includes four upstanding members 11 which are welded, one at each corner, to the generally rectangular lower frame sub-assembly 13. At the upper end of the four upstanding members 11 is welded a generally rectangularly and horizontally disposed sub-assembly frame 15 which defines a generally horizontal top side of the frame.

Referring again to the vertically disposed knife 9 at the forward end of the backbone frame member 1, it acts in cooperation with a log pusher block 20 which is slideably guided on the upper flange of the backbone member 1 by means of a guide block 22 which embraces the flange. A double-acting hydraulic cylinder 24 is connected at its rod end to the pusher block 20 and is connected at its cylinder as at 26 to an adjustable bracket 28 which also embraces the top flange of the backbone member 1. By loosening the bolt means 30, which extends through the rear end of the cylinder and through the bracket 28, the bracket 28 can be slideably adjusted and then fixed along the length of the backbone 1 to thereby accommodate logs of different lengths. Once the bolt means 30 is tightened on the frame member 1, the rear end of the cylinder is thus anchored securely in place. The member 1, which also forms a tongue portion of the frame, is rigid of such strength to absorb all of the thrust forces between the cylinder 24 and knife member 9.

A control 32 is provided at the front end of the frame for the purpose of actuating and controlling the double-acting hydraulic cylinder 24, and this control comprises a conventional hydraulic four-way two-position valve, spring biased into neutral position, which receives pressure fluid via conduits 34 from a hydraulic pump 36 rigidly located on the machine frame. An operating handle 38 is provided for the control 32 and is under the influence of the operator located adjacent the front of the machine. Thus, the operator can conveniently load the logs between the blade and the pusher and actuate the control 32 and perform the log splitting operation.

Figure 4:
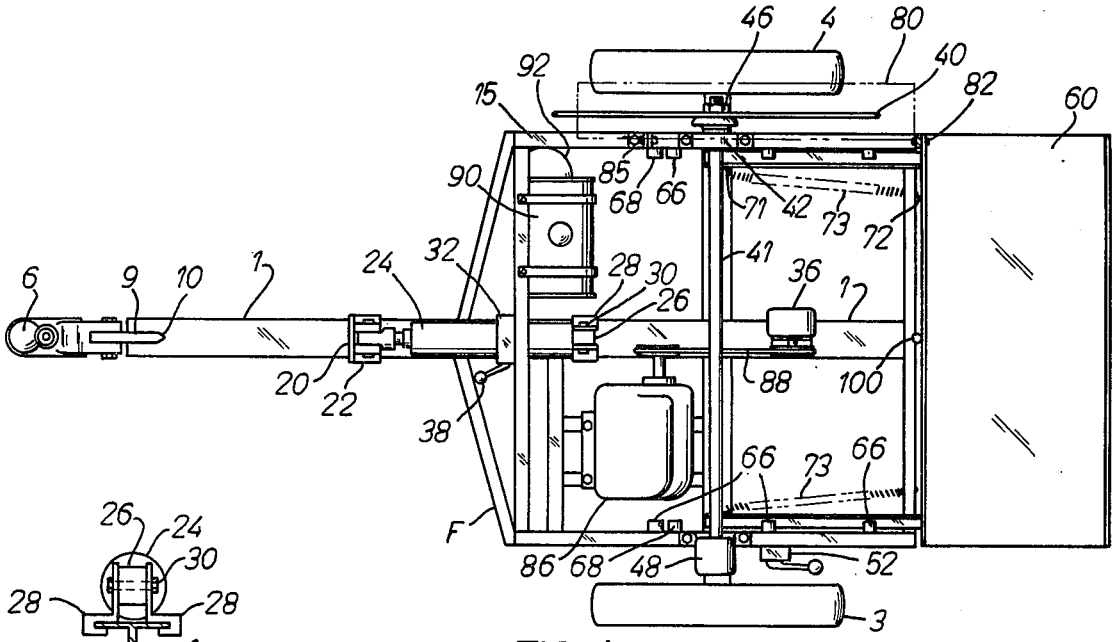
FIG. 4 is a plan view of the machine shown in FIG. 2.
Figure 8:
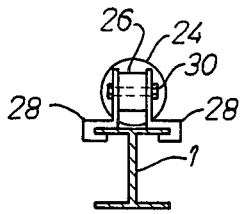
FIG. 8 is a cross-sectional view taken generally along the line 8—8 of FIG. 3.

A large circular saw blade 40 is secured by nut 46 (FIG. 4) to one end of a long drive shaft 41 which in turn is rotatably journalled on the top side of the frame at one end by the anti-friction pillow block bearing 42, and at the other end by a hydraulic motor 48, to be referred to. The saw blade is thus located at one side of the frame and extends thereabove and is rigidly held on the shaft by the large nut 46 threaded on the shaft end. As mentioned, at the end of the shaft 41, opposite from the saw blade 40, is a hydraulic motor 48 of conventional design and which receives pressure fluid via conduits 50 from the hydraulic pump 36. A manually actuated control 52 is provided for the motor 48 and may be a three-way, two-position valve spring biased into neutral, which is of conventional character.

Figure 2:
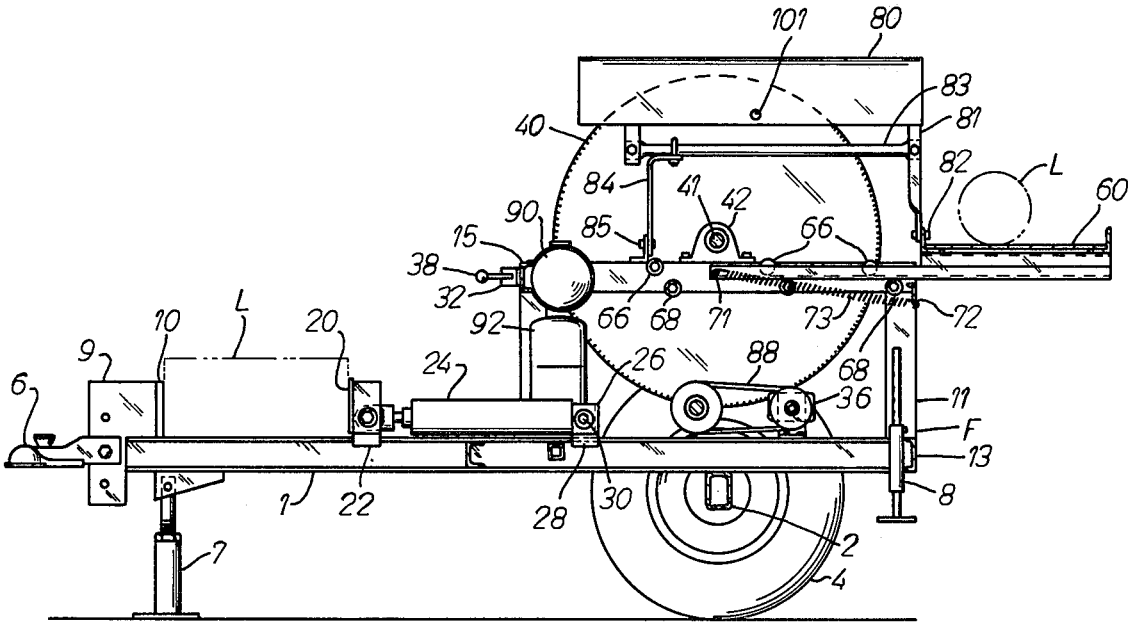
FIG. 2 is a side elevational view of the machine shown in FIG. 1, certain parts being shown in section or removed for the sake of clarity and showing the log feeding table in the retracted position and furthermore showing the log splitter in the retracted position.
Figure 3:
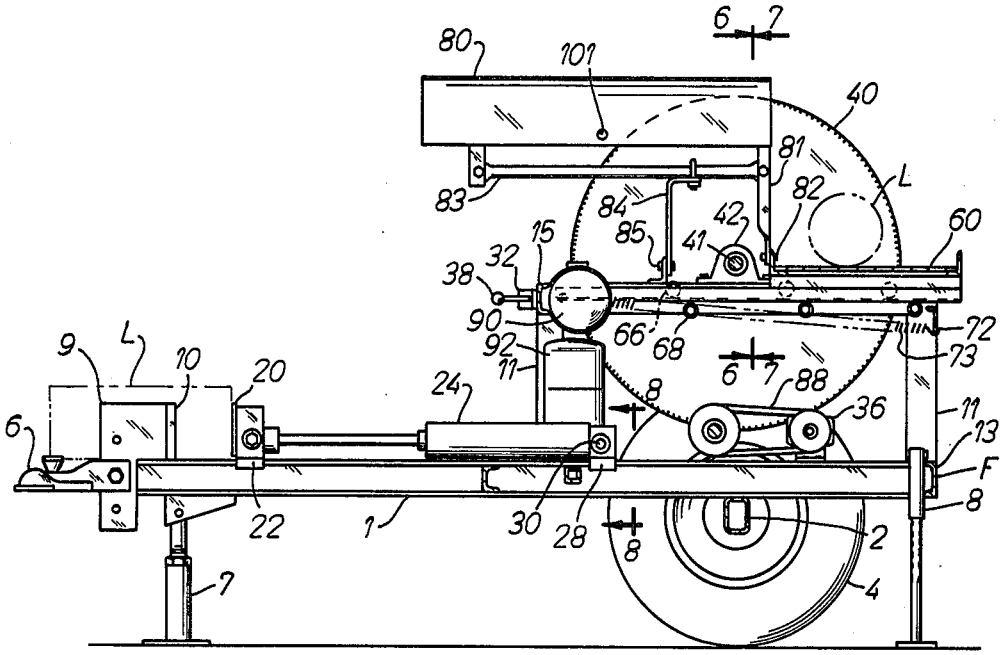
FIG. 3 is a view similar to FIG. 2 but showing the table moved to the forward log cutting position and furthermore showing the log splitter in the extended, splitting position.
Figure 7:
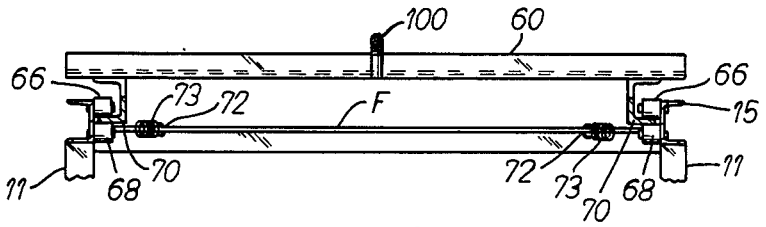
FIG. 7 is a sectional view taken generally along the line 7—7 of FIG. 3.
Figure 9:
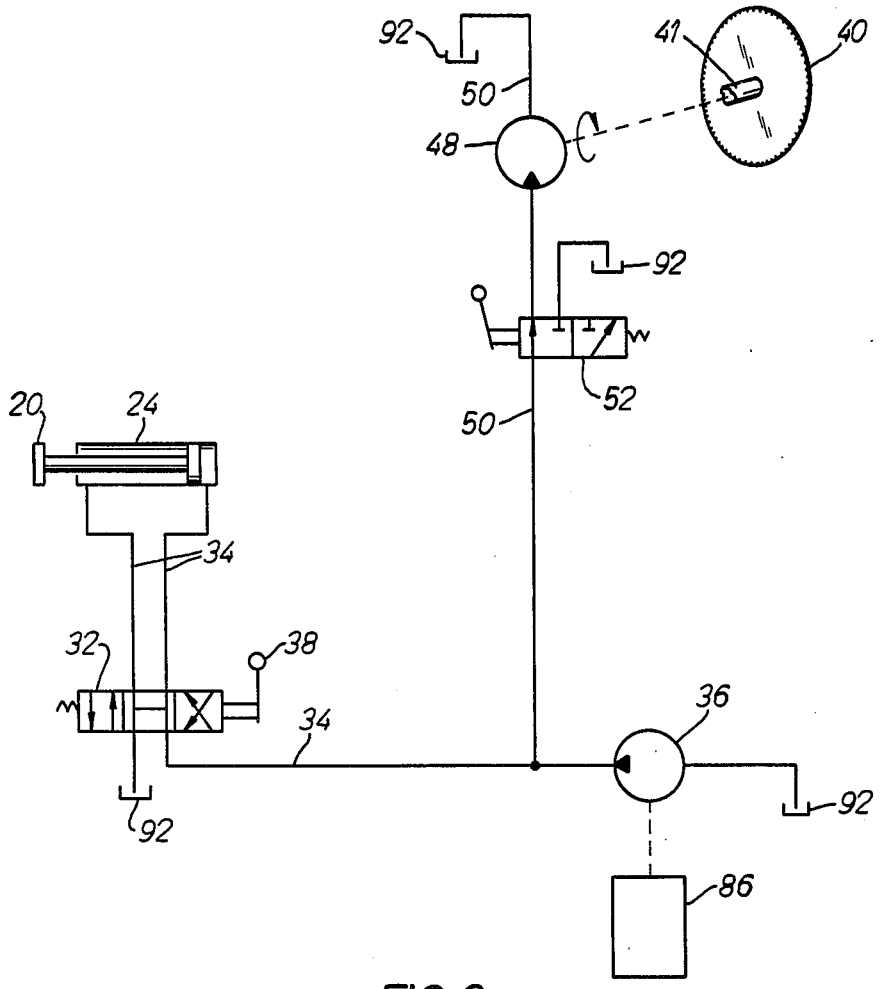
FIG. 9 is a schematic circuit diagram of the machine.

A table 60 is slideably mounted on the top side of the frame and extends transversely thereof and on which a log L (FIGS. 2 and 3) is placed and from which one end extends beyond the side of the frame for engagement by the saw blade when the table is moved forwardly by the operator. The table is slideably and guideably mounted on the top of the frame by means of rollers 66 and 68 mounted on the frame and between which rollers 66 and 68 the lower laterally extending flange 70 (FIG. 7) of the table frame extends. Thus, the table is held captive between the rollers 66 and 68 and is guided and slideably supported thereby for easy movement of the table between a rear loading position for the logs (FIGS. 2 and 4) and a forward log cutting positon (FIG. 3). The table is furthermore biased or resiliently urged to the loading position, that is, away from the saw blade, by means of the springs 73 anchored at one end 71 (FIG. 2) to the table and anchored at the other end 72 to the rear side of the frame. A saw guard 80 is of an inverted U cross-sectional shape and extends longitudinally of the machine to cover the top side of the blade. This guard is fastened by the rear bracket 81 by the bolt means 82 to the table so that the guard moves longitudinally with the table as a unit. A slide member 83 of the guard extends through and is guided by the bracket 84 which in turn is secured to the machine frame by the bolt means 85. Thus, the guard is guided in a sliding movement and supported by the frame. The arrangement is such that as the operator pushes the table forwardly to force the log L into contact with the blade, the guard 80 exposes the blade for the cutting function. Retraction of the table also causes retraction of the guard 80 and consequent covering of the saw blade again.

Figure 5:
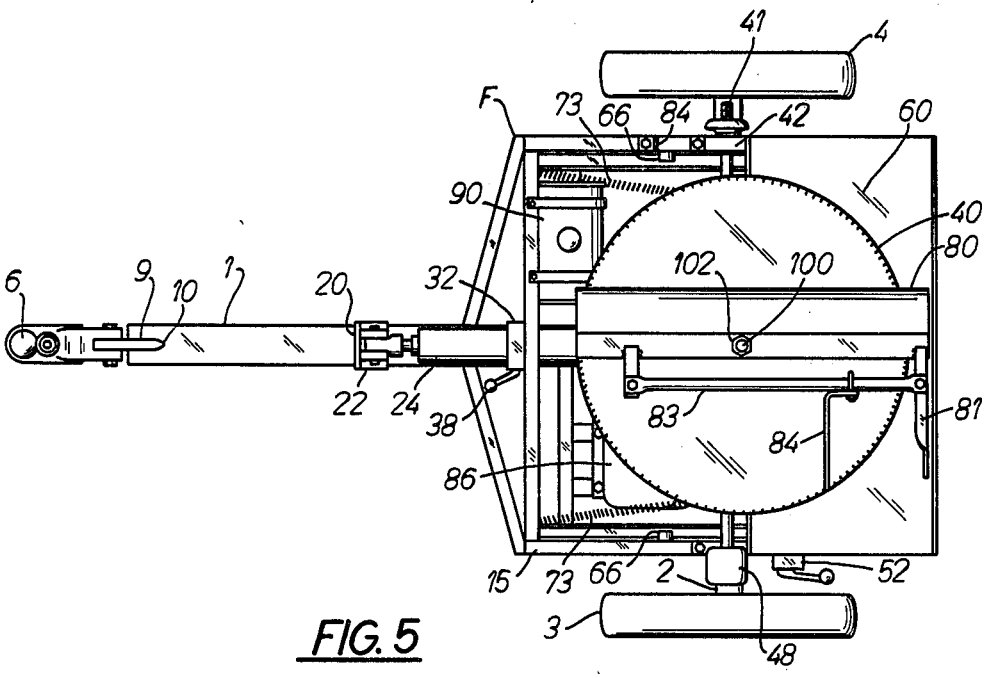
FIG. 5 is another plan view of the machine but showing the saw blade and its guard in the transport position.
Figure 6:
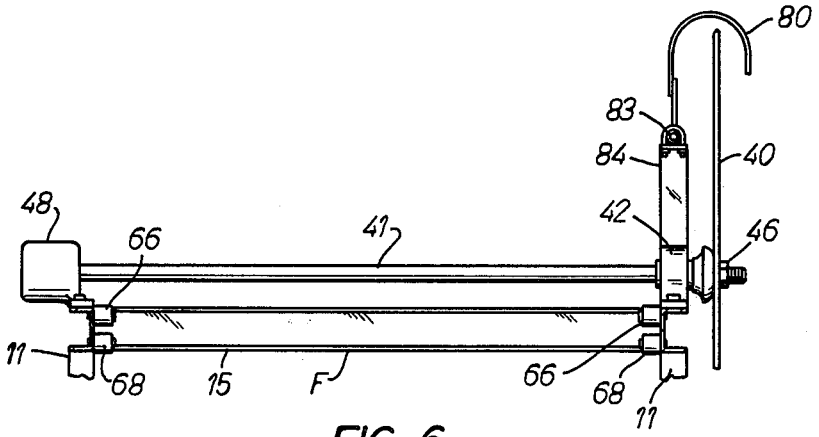
FIG. 6 is a sectional view taken generally along the line 6—6 of FIG. 3.

The machine is shown in FIG. 5 in the transport position wherein the saw blade has been removed from its shaft by removal of the nut 46 and the guard 80 has been removed by removal of the bolt means 82 and 85 so that the guard 80 and its support brackets can be removed as a unit. Stud 100 (FIG. 7) extends upwardly from the table 60 and the saw blade is mounted by its central aperture on the stud and the guard is also mounted on the stud by means of a hole 101 (FIGS. 2 and 3) which extend through the guard. A nut 102 (FIG. 5) then securely fastens the blade and its guard in a flat position on top of the machine for transport.

The single power source in the form of an internal combustion engine 86 is mounted on the machine frame and drives the hydraulic pump by the endless belt means 88. The pump in turn is connected, as previously described, to the hydraulic cylinder 24 and the hydraulic motor 48 to furnish pressurized fluid thereto through the appropriate control means mentioned. Thus, the single power source furnishes power to the log splitting and low sawing components for separate operation thereof. A fuel tank 90 for the internal combustion engine is also provided on the frame, and a reservoir 92 is provided on the frame for the hydraulic circuit.

The present invention provides a particularly compact and easily transportable power unit which is flexible in its operation and use. A minimum number of uncomplicated parts are provided for operating the log splitting and low sawing components, each of which is easily and safely operated.

I claim:

1. A combination log saw and splitter machine comprising: a mobile frame, a circular saw blade having a drive shaft rotatably mounted on said frame, a hydraulic motor connected to said drive shaft for rotatably driving said saw blade, fluid control means for said hydraulic motor, a log holding table slideably mounted on said frame for sliding movement thereon from a log loading position to a log cutting position whereby a log on said table and extending outwardly at one side of said frame is cut by said circular saw, a blade guard positioned over said blade and connected to said table for sliding movement therewith, and means for detachably securing said guard to said table and said frame, whereby said guard can be removed and mounted on said frame in a flat, storage position; a log splitting knife secured to said frame at a forward end thereof, a double acting hydraulic cylinder mounted on said frame, a pusher block slideably mounted on said frame and connected to and driven by said hydraulic cylinder for being urged toward and away from said knife whereby a log inserted between said pusher and said knife can be split by extension of said hydraulic cylinder, an internal combustion engine mounted on said frame, a hydraulic pump mounted on said frame and driven by said engine, another fluid control means for said hydraulic cylinder, both of said fluid control means separately connected to said hydraulic pump for receiving pressured fluid therefrom.

2. The log saw and splitter machine as set forth in claim 1 including roller guide means for slideably mounting said table on said frame, and spring means between said frame and said table for biasing said table to said log loading position.

3. A combination log saw and splitter machine comprising: a mobile frame, a circular saw blade having a drive shaft rotatably mounted on said frame, a hydraulic motor connected to said drive shaft for rotatably driving said saw blade, fluid control means for said hydraulic motor, a log holding table slideably mounted on said frame for sliding movement thereon from a log loading position to a log cutting position whereby a log on said table and extending outwardly at one side of said frame is cut by said circular saw, roller guide means for slideably mounting said table on said frame, and spring means between said frame and said table for biasing said table to said log loading position; a log splitting knife secured to said frame at a forward end thereof, a double acting hydraulic cylinder mounted on said frame, a pusher block slideably mounted on said frame and connected to and driven by said hydraulic cylinder for being urged toward and away from said knife whereby a log inserted between said pusher and said knife can be split by extension of said hydraulic cylinder, an internal combustion engine mounted on said frame, a hydraulic pump mounted on said frame and driven by said engine, another fluid control means for said hydraulic cylinder, both of said fluid control means separately connected to said hydraulic pump for receiving pressurized fluid therefrom.

4. A combination log saw and splitter machine comprising: a mobile frame having a top, a generally horizontal side and a rear side, a circular saw blade having a drive shaft rotatably mounted on said top side of same frame, said saw blade located adjacent one side of said top side and extending above said top side, a hydraulic motor connected to said drive shaft for rotatably driving said saw blade, fluid control means for said hydraulic motor, a log holding table slideably mounted on said top side and extending transversely thereof and for sliding movement thereon from a log loading position adjacent said rear side of said frame to a log cutting position forwardly of said rear side whereby a log on said table and extending outwardly at said one side of said frame is cut by said circular saw, roller guide means for slideably mounting said table on said frame, and spring means between said frame and said table for biasing said table to said log loading position; said frame having a forwardly extending tongue portion, a log splitting knife secured to said tongue portion at a forward end thereof, a double acting hydraulic cylinder mounted on said frame and having its longitudinal axis generally parallel with said tongue portion, a pusher block slideably mounted on said tongue portion and connected to and driven by said hydraulic cylinder for being urged toward and away from said knife whereby a log inserted between said pusher and said knife can be split by extension of said hydraulic cylinder, an internal combustion engine mounted on said frame, a hydraulic pump mounted on said frame and driven by said engine, another fluid control means for said hydraulic cylinder, both of said fluid control means connected to said hydraulic pump for receiving pressurized fluid therefrom, said hydraulic cylinder and said hydraulic motor being independently and selectively actuated and controlled.

5. A combination log saw and splitter machine comprising: a mobile frame having a top, generally horizontal side and a rear side, a circular saw blade having a drive shaft rotatably mounted on said top side of said frame, said saw blade located adjacent one side of said top side and extending above said top side, a hydraulic motor connected to said drive shaft for rotatably driving said saw blade, fluid control means for said hydraulic motor, a log holding table slideably mounted on said top side and extending transversely thereof and for sliding movement thereon from a log loading position adjacent said rear side of said frame to a log cutting position forwardly of said rear side whereby a log on said table and extending outwardly at said one side of said frame is cut by said circular saw, roller guide means for slideably mounting said table on said frame, and spring means between said frame and said table for biasing said table to said log loading position; said frame having a forwardly extending tongue portion, said frame includes a central structural steel member constituting said tongue portion and extending to the said rear side of said frame and constituting the rigid back bone thereof, a log splitting knife secured to said tongue portion at a forward end thereof, a double acting hydraulic cylinder mounted on said frame and having its longitudinal axis generally parallel with said tongue portion, a pusher block slideably mounted on said tongue portion and connected to and driven by said hydraulic cylinder for being urged toward and away from said knife whereby a log inserted between said pusher and said knife can be split by extension of said hydraulic cylinder, an internal combustion engine mounted on said frame, a hydraulic pump mounted on said frame and driven by said engine, another fluid control means for said hydraulic cylinder, both of said fluid control means connected to said hydraulic pump for receiving pressurized fluid therefrom, said hydraulic cylinder and said hydraulic motor being independently and selectively actuated and controlled.

6. A combination log saw and splitter machine comprising: a mobile frame having a top, generally horizontal side and a rear side, a circular saw blade having a drive shaft rotatably mounted on said top side of said frame, said saw blade located adjacent one side of said top side and extending above said top side, a hydraulic motor connected to said drive shaft for rotatably driving said saw blade, fluid control means for said hydraulic motor, a log holding table slideably mounted on said top side and extending transversely thereof and for sliding movement thereon from a log loading position adjacent said rear side of said frame to a log cutting position forwardly of said rear side whereby a log on said table and extending outwardly at said one side of said frame is cut by said circular saw, a blade guard positioned over said blade and connected to said table for sliding movement therewith, and means for detachably securing said guard to said table and said frame, whereby said guard can be removed and mounted on said frame in a flat, storage position; said frame having a forwardly extending tongue portion, a log splitting knife secured to said tongue portion at a forward end thereof, a double acting hydraulic cylinder mounted on said frame and having its longitudinal axis generally parallel with said tongue portion, a pusher block slideably mounted on said tongue portion and connected to and driven by said hydraulic cylinder for being urged toward and away from said knife whereby a log inserted between said pusher and said knife can be split by extension of said hydraulic cylinder, an internal combustion engine mounted on said frame, a hydraulic pump mounted on said frame and driven by said engine, another fluid control means for said hydraulic cylinder, both of said fluid control means connected to said hydraulic pump for receiving pressurized fluid therefrom, said hydraulic cylinder and said hydraulic motor being independently and selectively actuated and controlled.

7. A combination log saw and splitter machine comprising: a mobile frame having a top, generally horizontal side and a rear side, a circular saw blade having a drive shaft rotatably mounted on said top side of said frame, said saw blade located adjacent one side of said top side and extending above said top side, a hydraulic motor connected to said drive shaft for rotatably driving said saw blade, fluid control means for said hydraulic motor, a log holding table slideably mounted on said top side and extending transversely thereof and for sliding movement thereon from a log loading position adjacent said rear side of said frame to a log cutting position forwardly of said rear side whereby a log on said table and extending outwardly at said one side of said frame is cut by said circular saw, roller guide means between said table and said frame for slideably mounting said table on said frame, said frame having a forwardly extending central structural steel member extending to said rear side of said frame and also forming a tongue portion extending forwardly of said frame for connection to a towing vehicle, a log splitting knife secured to said tongue portion at a forward end thereof, a double acting hydraulic cylinder mounted on said tongue portion and having its longitudinal axis generally parallel therewith, a pusher block slideably mounted on said tongue portion and connected to one end of and driven by said hydraulic cylinder for being urged toward and away from said knife whereby a log inserted between said pusher and said knife can be split by extension of said hydraulic cylinder, means for adjustably securing the other end of said hydraulic cylinder to said tongue portion to accommodate logs of different lengths, an internal combustion engine mounted on said frame, a hydraulic pump mounted on said frame and driven by said engine, another fluid control means for said hydraulic cylinder, said fluid control means being separately connected to said hydraulic pump for receiving pressurized fluid separately therefrom, said hydraulic cylinder and said hydraulic motor being independently and selectively actuated.

* * * * *